US009976337B2

(12) United States Patent
Kirchhoff

(10) Patent No.: US 9,976,337 B2
(45) Date of Patent: May 22, 2018

(54) ACTUATOR FOR OPENING AND CLOSING LID FOR BULK STORAGE BIN

(71) Applicant: David Alan Kirchhoff, Tripoli, IA (US)

(72) Inventor: David Alan Kirchhoff, Tripoli, IA (US)

( * ) Notice: Subject to any disclaimer, the term of this patent is extended or adjusted under 35 U.S.C. 154(b) by 0 days. days.

(21) Appl. No.: 15/269,975

(22) Filed: Sep. 19, 2016

(65) Prior Publication Data

US 2017/0081905 A1 Mar. 23, 2017

Related U.S. Application Data

(60) Provisional application No. 62/220,825, filed on Sep. 18, 2015.

(51) Int. Cl.

| | |
|---|---|
| ***E06B 3/50*** | (2006.01) |
| ***E05F 15/627*** | (2015.01) |
| ***E05F 15/622*** | (2015.01) |
| ***E05F 15/614*** | (2015.01) |
| ***E06B 3/52*** | (2006.01) |

(52) U.S. Cl.

CPC ..... *E06B 3/509* (2013.01); *E05F 15/614* (2015.01); *E05F 15/622* (2015.01); *E05F 15/627* (2015.01); *E06B 3/52* (2013.01); *E05Y 2900/602* (2013.01)

(58) Field of Classification Search

CPC ..... E04H 7/22; B65D 90/54; B65D 90/66; B65D 90/623; B65D 90/626; B65D 2590/662; B65D 43/16; B65D 43/18; B65D 43/20; B65D 43/26

USPC ..... 52/192; 49/349, 357; 220/810–813, 820

See application file for complete search history.

(56) References Cited

U.S. PATENT DOCUMENTS

| | | | | | |
|---|---|---|---|---|---|
| 1,324,667 | A * | 12/1919 | Hanson | B65F 1/163 | 220/263 |
| 1,461,253 | A * | 7/1923 | Owen | B65F 1/163 | 220/262 |
| 3,262,227 | A * | 7/1966 | Pentecost | A62B 13/00 | 16/231 |
| 5,570,547 | A * | 11/1996 | Webb | B65D 88/08 | 220/247 |
| 5,586,678 | A * | 12/1996 | Rosch | B65D 90/10 | 220/262 |

(Continued)

FOREIGN PATENT DOCUMENTS

| | | | | |
|---|---|---|---|---|
| CA | 2847047 | A1 * | 9/2014 | B65D 90/10 |

*Primary Examiner* — Robert Canfield

(74) *Attorney, Agent, or Firm* — McKee, Voorhees & Sease, PLC

(57) ABSTRACT

An actuator opens and closes a lid on a bulk storage container. The actuator may be activated remotely using a remote control. When actuated, the actuator will lift the lid so that it is clear of the structure, and will then rotate the lid in a horizontal plan about a vertical axis until the lid is rotated to uncover the opening. The axis of rotation is located near the perimeter of the opening, so that very little of the lid remains over the opening when in the open position. To close the lid from the open position, the remote control may then in be used to actuate the closing process. The closing process works in reverse of the opening process. Therefore, during closing, the lid will rotate back to its original orientation over the hole and then lower into the closed position.

6 Claims, 18 Drawing Sheets

(56) References Cited

U.S. PATENT DOCUMENTS

| | | | | |
|---|---|---|---|---|
| 5,839,597 | A * | 11/1998 | Marttila | B65D 90/10 220/264 |
| 8,763,323 | B1 * | 7/2014 | Even | E04H 7/22 49/349 |
| 9,051,117 | B2 * | 6/2015 | Kirchhoff | B65D 90/10 |
| 2011/0024418 | A1 * | 2/2011 | Batson | B65D 90/585 220/211 |
| 2014/0263325 | A1 * | 9/2014 | Kirchhoff | B65D 90/10 220/262 |

* cited by examiner

ACTUATOR FOR OPENING AND CLOSING LID FOR BULK STORAGE BIN

CROSS-REFERENCE TO RELATED APPLICATIONS

This application claims the benefit of U.S. Provisional Application Ser. No. 62/220,825 filed Sep. 18, 2015, the entire contents of which are hereby incorporated by reference.

FIELD OF THE INVENTION

The present invention generally relates to automated actuators, and more particularly to actuators used to open and close covers for storage bins.

BACKGROUND OF THE INVENTION

A bulk storage bin, such as a grain storage bin, have an opening in its top to provide access for loading bulk materials into the storage bin. Typically, this opening will have a lid or other cover that may be selectively placed over the opening to protect the contents of the storage bin from the elements. These lids or covers may generally cannot be reached by the user at ground level, and the user is required to climb to the top of the storage bin in order to adjust the lid between the open and closed position. Climbing to the top of such storage bins can be inconvenient, and especially in rainy and windy conditions, can be dangerous.

Another disadvantage associated with lids for bulk storage bins is that they often open by rotating about a horizontal hinge. This can be disadvantageous because the space above the opening must be free from obstructions in order for the lid to be fully rotated to an open configuration.

SUMMARY OF THE INVENTION

The present invention relates to an improved mechanism for opening and closing a lid on a bulk storage container. According to one embodiment, the invention includes an actuator that may be activated remotely using a remote control, for example of the type that might be included on a key fob. When actuated, the actuator will lift the lid just enough so that it is clear of the structure, and will then rotate the lid in a horizontal plan about a vertical axis until the lid is rotated to uncover the opening. The axis of rotation is located near the perimeter of the opening, so that very little of the lid remains over the opening when in the open position. To close the lid from the open position, the remote control may then again be used to actuate the closing process. The closing process works in reverse of the opening process. Therefore, during closing, the lid will rotate back to its original orientation over the hole and then lower into the closed position.

According to another embodiment, the present invention is directed to a device for opening and closing a lid on a bulk storage bin. A bracket is mounted to the storage bin near an opening at a top of the storage bin. An actuator is mounted to the bracket in operable connection to the lid. The actuator includes a first motor that selectively rotates a lifting screw. The lifting screw is operably connected to a lifting member. The lifting member is operably connected to the lid to raise and lower the lid in response to rotation of the lifting screw by the first motor. The actuator further includes a bevel gear supported by the lifting member. A second motor is fixed to an underside of the lid. The second motor rotates a gear that meshes with the bevel gear, to cause the motor and lid combination to rotate in a planetary fashion around the bevel gear when the second motor is activated. The first motor may be engaged to rotate the screw lift, in order to lift the lid from a closed position to a raised position above the opening. The second motor may be activated to rotate the lid from the raised position to an open position. A remote control in communication with the actuator may be used to trigger the activation of the first and second motors sequentially. Limit switches may be used to terminate movement of the lid in the desired raised and open positions.

According one embodiment, the present invention is a device for opening and closing a lid on a bulk storage bin. The lid covers an opening at an upper area of the bin. The device includes an actuator mounted to the bin in operable connection to the lid. The actuator is adapted to lift the lid from a closed position to a raised position above the opening, and then to rotate the lid from the raised position about a vertical axis located at a periphery of the opening until the lid is in an open position. The actuator is further adapted to rotate the lid from the open position back to the raised position and to lower the lid from the raised position to the closed position. A remote control may be provided that is in communication with the actuator to trigger the actuator to move the lid from the closed position to the open position and from the open position to the closed position. A bracket may secure the device to atop portion of the storage bin. A lift device may provide a lifting force to move the lid from the closed position to the raised position. The lifting device may be a linear actuator. A rotation motor may be provided to rotate the lid between the raised position and the open position. A limit switch may sense a position of the lid and shut off the rotation motor when the lid approaches the open position. The rotation motor may rotate a spur gear that meshes with a driven gear operably fixed to the lid. A lid support mounted to the upper area of the bin in alignment with the open position of the lid to support the lid in the open position. The actuator may include a mounting plate secured in a fixed position relative to the bin; a linear actuator mounted to the mounting plate, and having an extendable actuator rod; a lift plate connected to the extendable actuator rod above the mounting plate, whereby extension of the extendable actuator rod causes the lift plate to be raised; a rotation plate rotatably mounted to the lift plate by a pivot member, with the rotation plate being above and spaced apart from the lift plate; a driven gear fixed to a lower portion of the rotation plate and centered at the pivot member; and a motor mounted to the lift plate, the motor driving a spur gear that meshes with the driven gear, whereby activation of the motor causes the spur gear to rotate, which in turn drives the driven gear and causes the rotation plate to rotate about the pivot member. The lid may be fixed relative to the rotation plate.

According to another embodiment of the present invention, a device for moving a lid between a closed position covering an opening at a top of a bulk storage bin and an open position wherein the lid is substantially removed from the opening includes a bracket mounted to the storage bin near the opening. An actuator supported by the bracket in operable connection to the lid. The actuator has: a mounting plate secured in a fixed position relative to the bin by the bracket; a linear actuator mounted to the mounting plate, the linear actuator having an extendable actuator rod; a lift plate connected to the extendable actuator rod above the mounting plate, whereby extension of the extendable actuator rod causes the lift plate to be raised; a rotation plate rotatably mounted to the lift plate by a pivot member that defines a generally vertical pivot axis, with the rotation plate being above and spaced apart from the lift plate; a driven gear fixed to a lower portion of the rotation plate and centered at the pivot member; and a motor mounted to the lift plate, the motor driving a spur gear that meshes with the driven gear, whereby activation of the motor causes the spur gear to rotate, which in turn drives the driven gear and causes the rotation plate to rotate about the pivot member. The lid is fixed relative to the rotation plate, whereby the lid can be moved from the closed position to a raised position directly above the opening by extending the extendable actuator rod, and the lid can be moved from the raised position to the open position by rotating the spur gear. A remote control in communication with the actuator triggers the actuator to move the lid from the closed position to the open position and from the open position to the closed position. A lid support is mounted to an upper surface of the bin. The lid support adapted to support the lid when the lid is in the open position. The lid support may have a pair of uprights; a lower cross member spanning between the uprights; and an upper cross member spanning between the uprights. The lid support may also include adjustable feet that adjust to match a slope of the upper surface of the bin. The uprights may each include a plurality of slots that permit adjustment of the heights of the cross members.

DETAILED DESCRIPTION OF THE PREFERRED EMBODIMENTS

The present invention relates to a mechanism for remotely opening and closing a lid on a bulk storage bin. The mechanism may be provided as original equipment as part of the bin, or may be an aftermarket kit that can be added onto existing structures. The mechanism allows lids to be automatically opened from the ground using a remote controller that opens and closes the lid as desired. Therefore, the mechanism allows the lid to opened and closed without the need to climb to the top of the storage structure.

Figure 1:
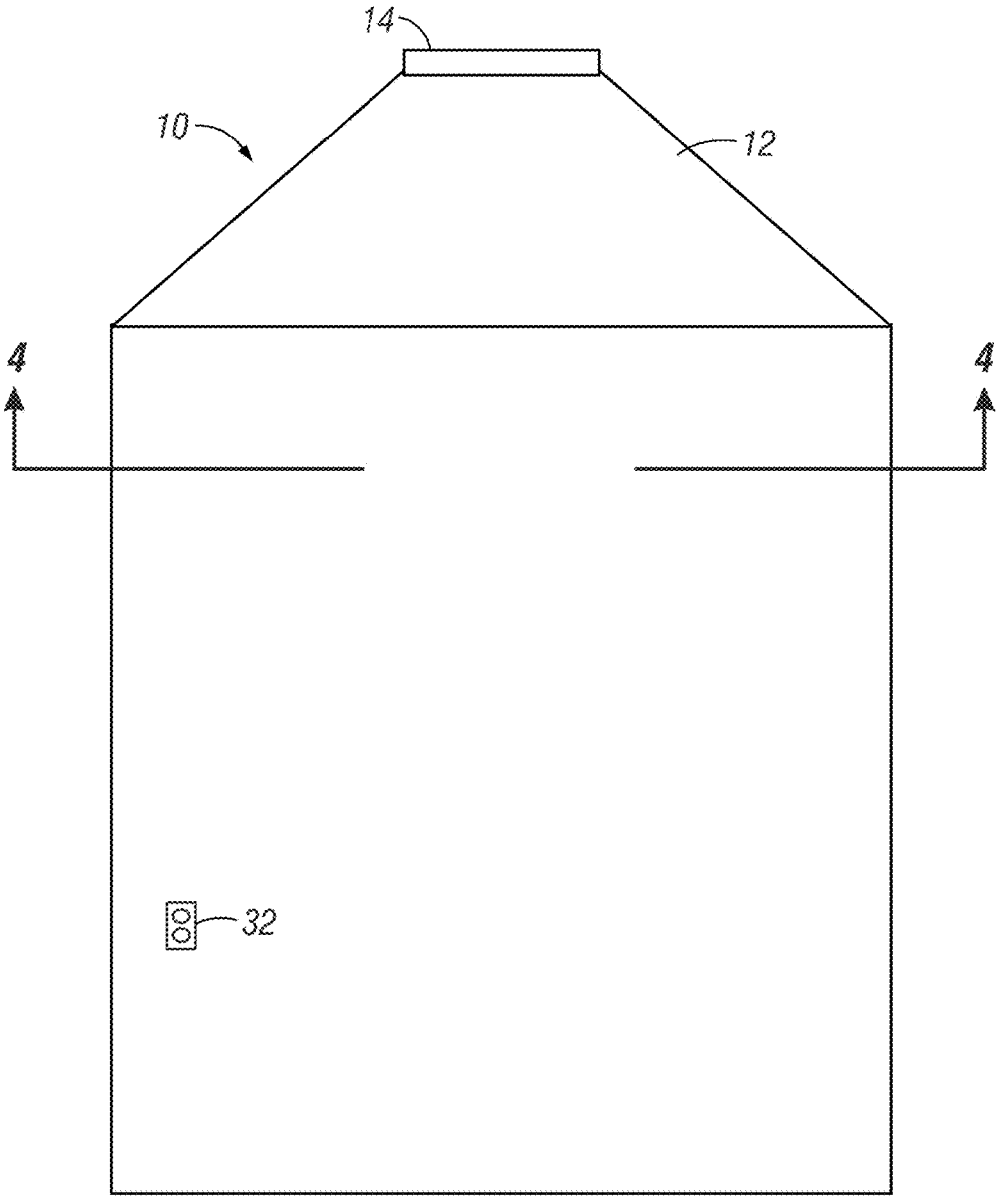
FIG. 1 shows a bulk storage bin with a lid in a closed position.
Figure 2:
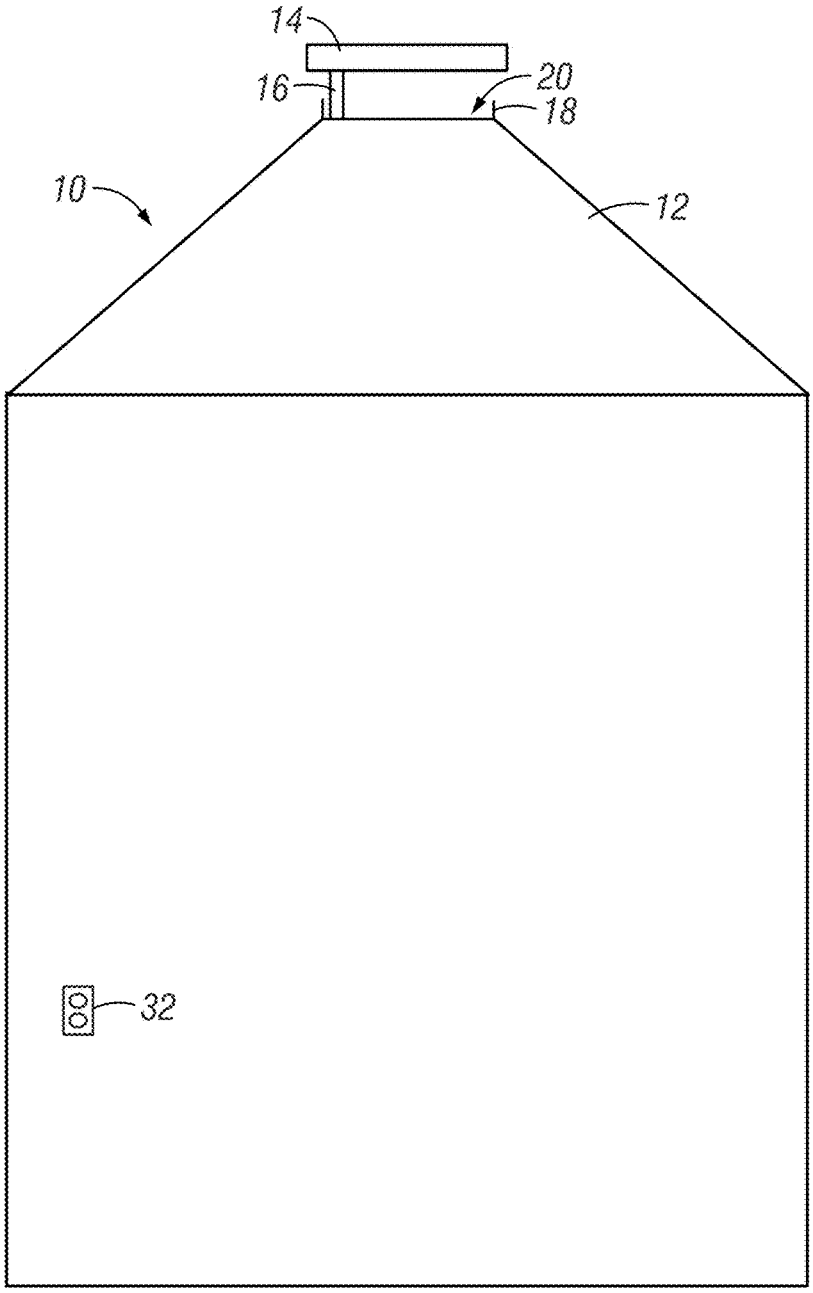
FIG. 2 shows the storage bin of FIG. 1 with the lid moved to a raised position by an actuator according to one embodiment of the present invention.
Figure 3:
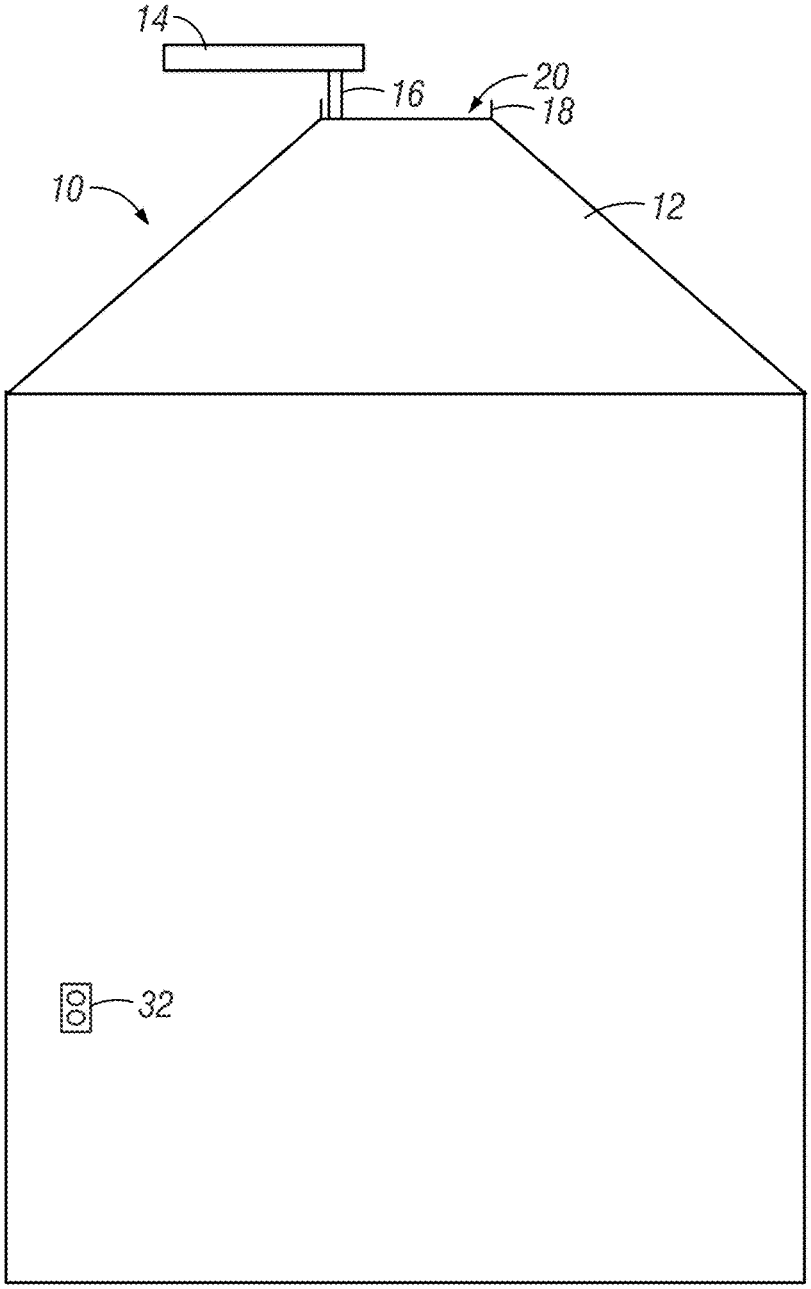
FIG. 3 shows the storage bin of FIG. 2 with the lid rotated to an open position using the actuator.

FIGS. 1-3 show a front elevation view of a storage bin 10 that has been equipped with an actuator 16 according to one embodiment of the present invention. The storage bin 10 may take many configurations. In the configuration show, the storage bin 10 is of the type used to store grain. The storage bin 10 includes a roof 12 that forms atop cover for the storage bin 10. The roof 12 has a slanted surface to help repel water off to the sides of the structure, and to generally match the contour of grain, or other loose material that gets piled and has a conical top.

The roof 12 includes an upward facing opening 20 that is de fined by atop ring 18. FIG. 1 shows the storage bin 10 with the opening 20 covered by lid 14. When in a closed configuration as shown in FIG. 1, the lid 14 helps prevent precipitation such as snow and rain from getting into the interior of the storage bin 10. Additionally, the lid 14 may help keep small animals such as birds, mice, and rats from getting into the storage bin 10.

FIG. 2 shows the storage bin 10 with the lid 14 in an intermediate raised position. In FIG. 2, the actuator 16 has been activated to raise the lid 14 a small distance above the top ring 18. The lid 14 should be raised by the actuator 16 a sufficient distance such that the bottom edge of the lid 14 has clearance above the ring 18, so that there will be no interference by the ring 18 to rotation of the lid 14 in a horizontal plane. The raised position of FIG. 2 is generally an intermediate position reached while the lid 14 is moving between the closed and opened positions. Therefore, while it may be possible to retain the lid 14 in the raised position of FIG. 2, it will not be common to leave it in such a position.

FIG. 3 shows the storage bin 10 with the lid 14 adjusted to the fully open position. To move from the raised position of FIG. 2 to the open position of FIG. 3, the actuator 16 rotates the lid 14 about a vertical axis through an arc of about 180°. In the open position of FIG. 3, only a very small portion of the lid 14 remains above the opening 20. Therefore, a user is free to add material to the storage bin 10 through the opening 20 while the lid 14 is in the open position of FIG. 3.

Figure 7A:
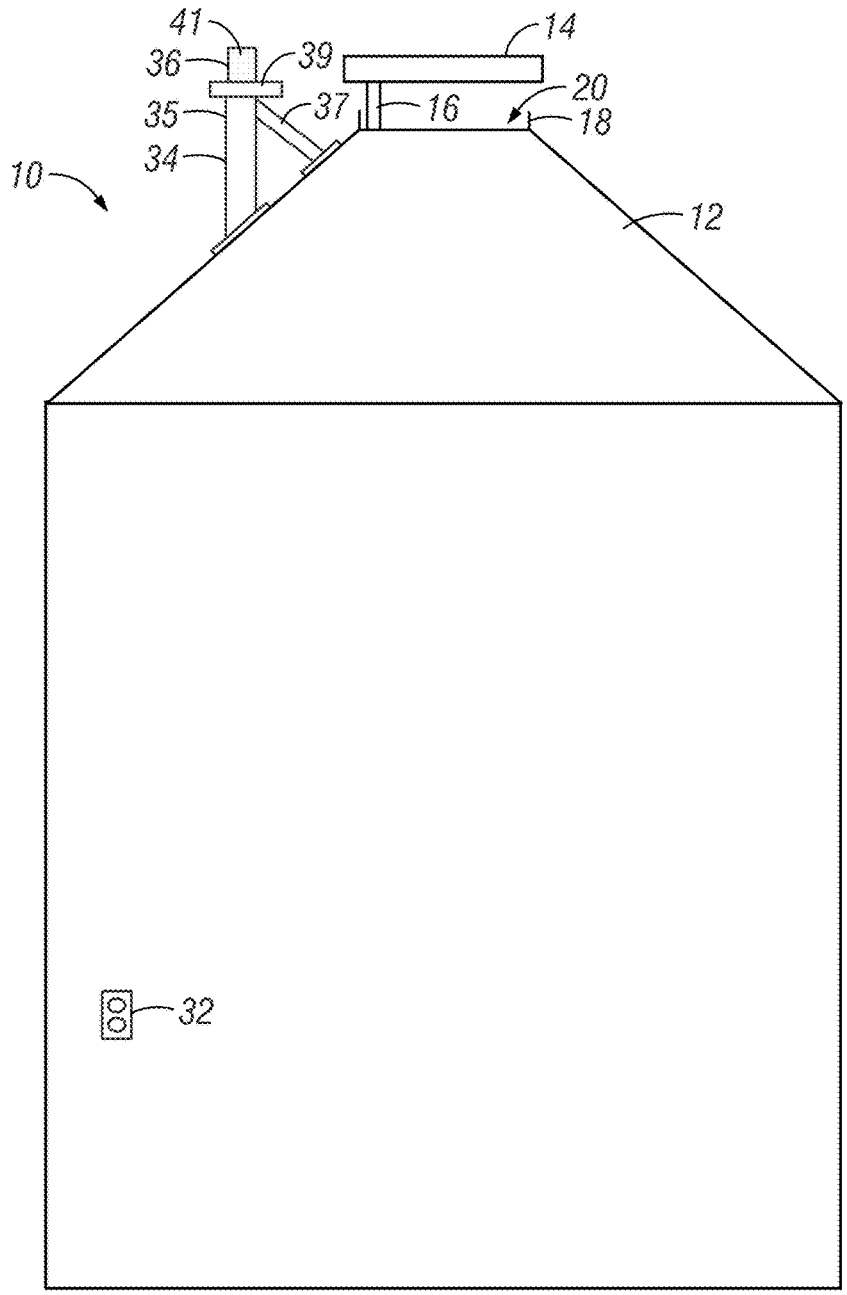
FIG. 7A is an elevation view of a storage bin with its lid raised to a raised position wherein the bin includes a lid support.
Figure 7B:
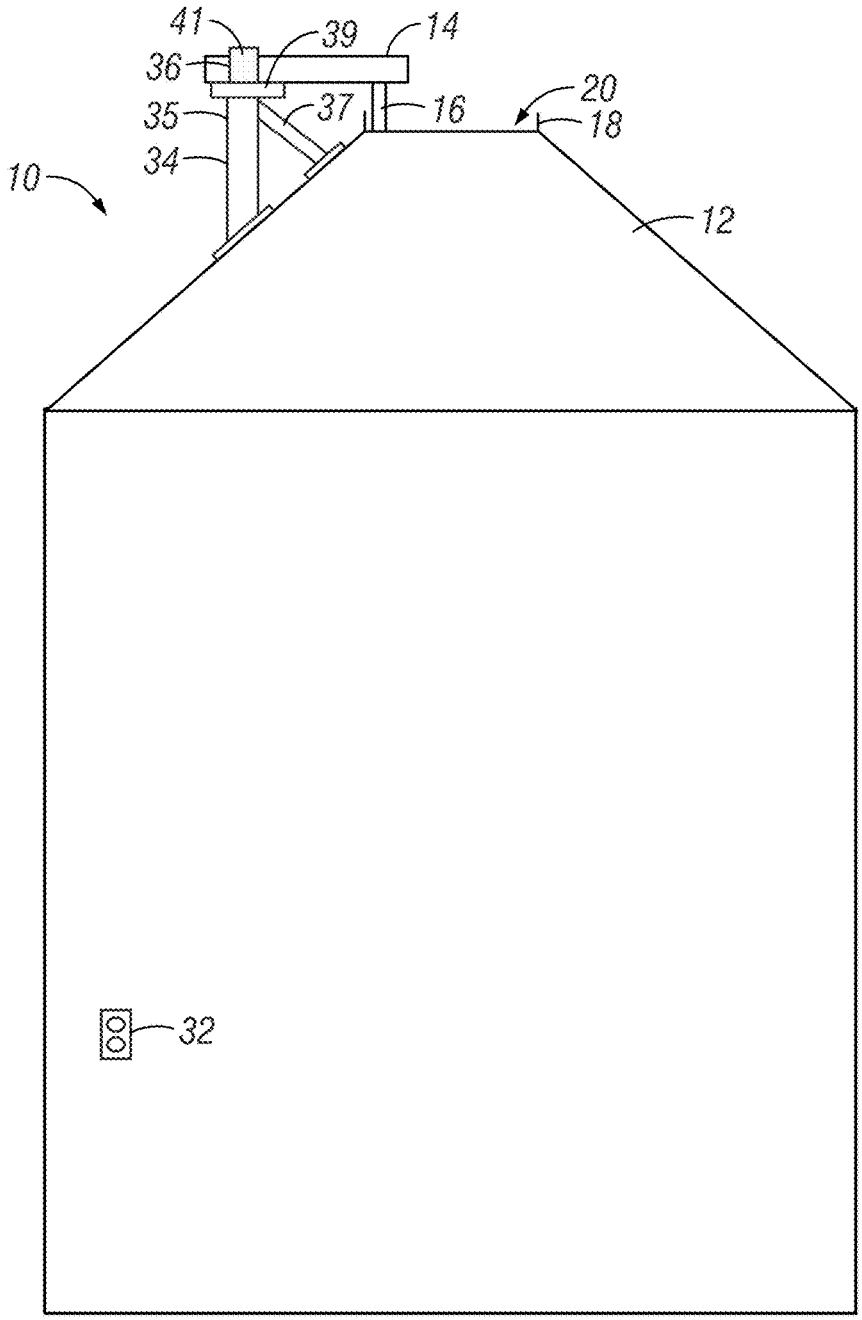
FIG. 7B shows the bin of FIG. 7A, with the lid in an open position supported by the lid support.
Figure 8:
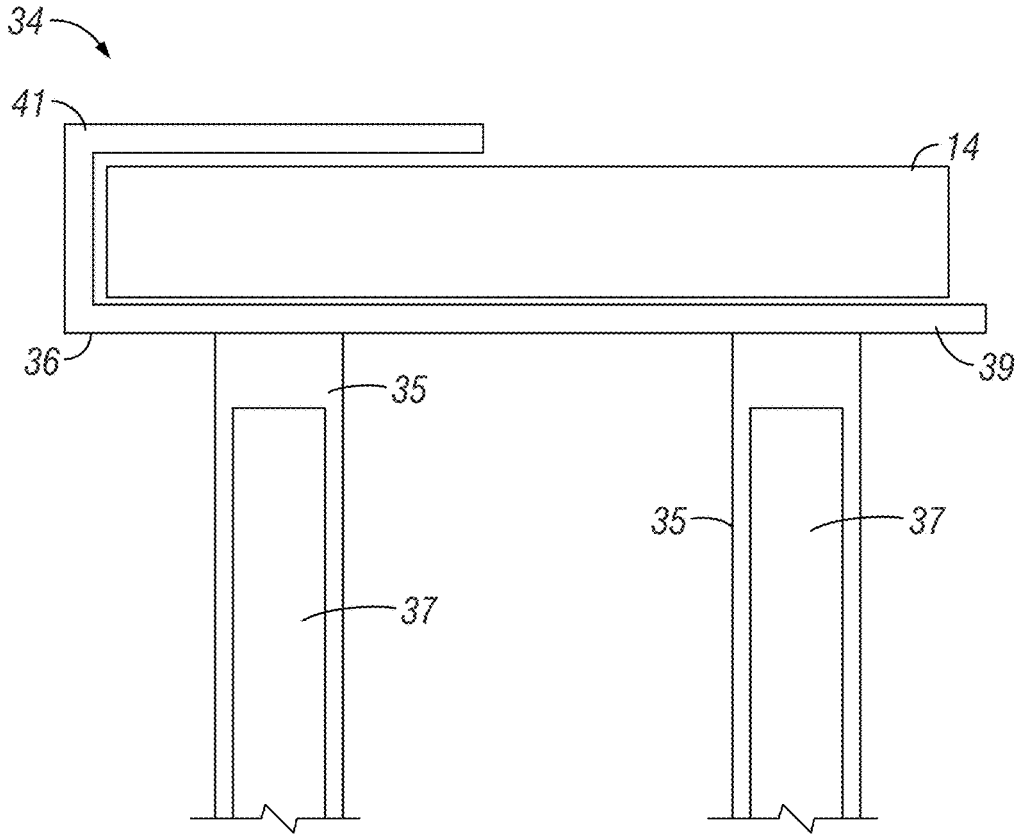
FIG. 8 is a detail partial view of the lid support of FIG. 7B.

FIGS. 7A, 7B, and 8 illustrate an alternative embodiment that includes a lid support 34 that is attached to the roof 12. The lid support 34 may be used to provide support for the lid 14 when the lid 14 is in the open position. This alternative arrangement of FIGS. 7A-C is useful when it is desired to retain the lid 14 in the open position for an extended time. The support 34 serves to help support the weight of the lid 14 so that it does not need to be entirely supported by the actuator 16 during long time periods. The support 34 also helps retain the lid 14 against additional forces that may be caused during windy conditions. The lid support 34 includes a vertical leg (or legs) 35 that support a lid cradle 36. Brace (or braces) 37 may be provided to provide additional support to the vertical legs 35. Preferably the vertical legs 35 and braces 37 will be adjustable in order to be usable on roofs of varying pitches.

As best seen in FIG. 8, the cradle 36 includes a horizontal support 39 and a retainer portion 41. The retainer portion 41 has generally a C-shaped cross section, and extends back over a portion of the horizontal support 39. The combination of the horizontal support 39 and the retainer portion 41 helps retain the lid 12 against windy conditions to prevent transmitting damaging forces to the actuator 16. The horizontal support may bear some of the weight of the lid 14 even during calm conditions.

A controller 32 is provided to allow a user to control the opening and closing of the lid 14 by the actuator 16. The controller 32 may be mounted to the bin 10, as shown in FIGS. 1-3, or the controller 32 may be a small stand alone remote control, such as a key fob remote, or other dedicated remote control. As a further alternative, other technologies, such as smart phones and like may be used to remotely activate and control the actuator 16.

Power may be supplied to the actuator 16 through a variety of known mechanisms. Commonly, large storage bins, such as grain storage bins, include wiring that provides 110 volts of alternating current (AC) at the top of the storage bin. For example, it is common to include grain spreaders that are powered by 110 volts of alternating current near the opening 20. Alternatively, wiring could be run to the bin 10 especially for connection to the actuator 16. As a further alternative, rechargeable batteries that are recharged by solar or wind power could be used to provide power to the actuator 16. According to a preferred embodiment, the actuator 16 includes two DC motors and an AC to DC power converter that converts the 110 volts AC current to the appropriate DC current for the motors.

Figure 4:
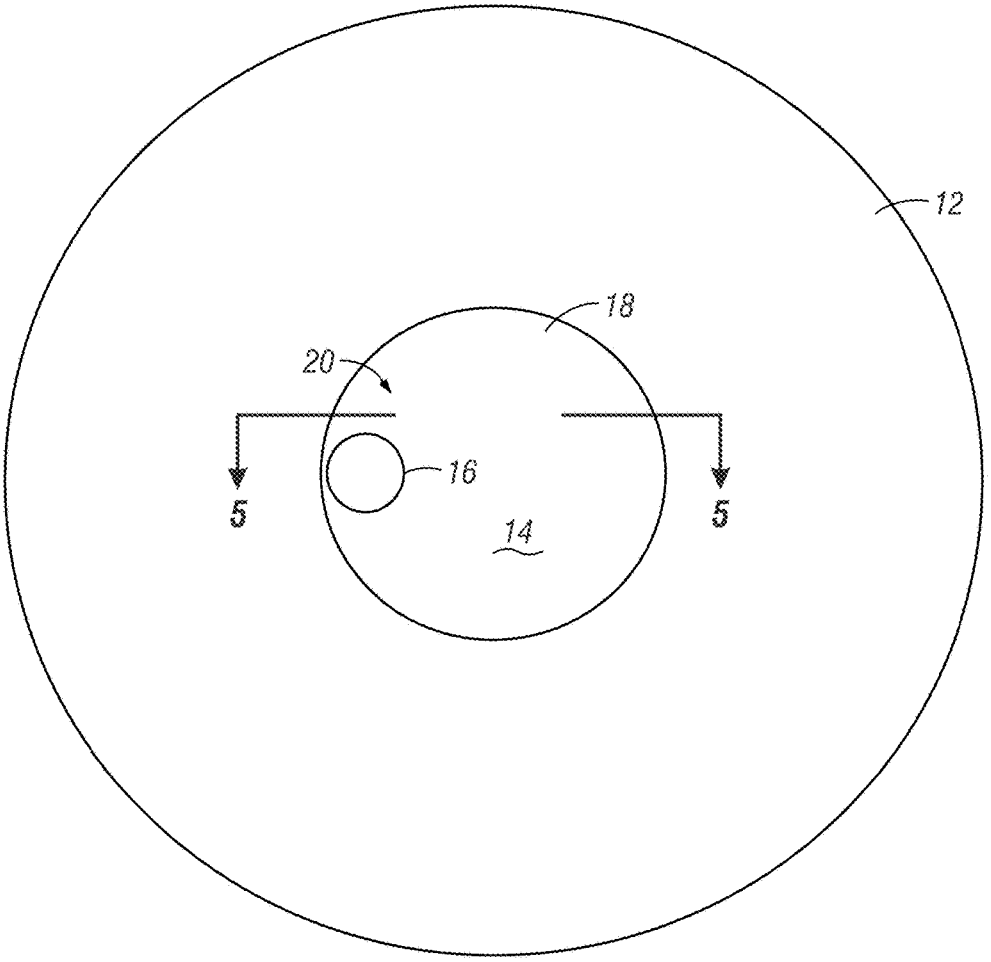
FIG. 4 is a cross-section view looking up at the actuator, opening, and lid of the storage bin of FIG. 1.

FIG. 4 is across-sectional view of the bin 10 of FIG. 1 generally looking upwardly from the inside at the roof 12 of the bin 10. As can be seen in FIG. 4, the actuator 16 is mounted to the ring 18 at one side of the opening 20.

Figure 5:
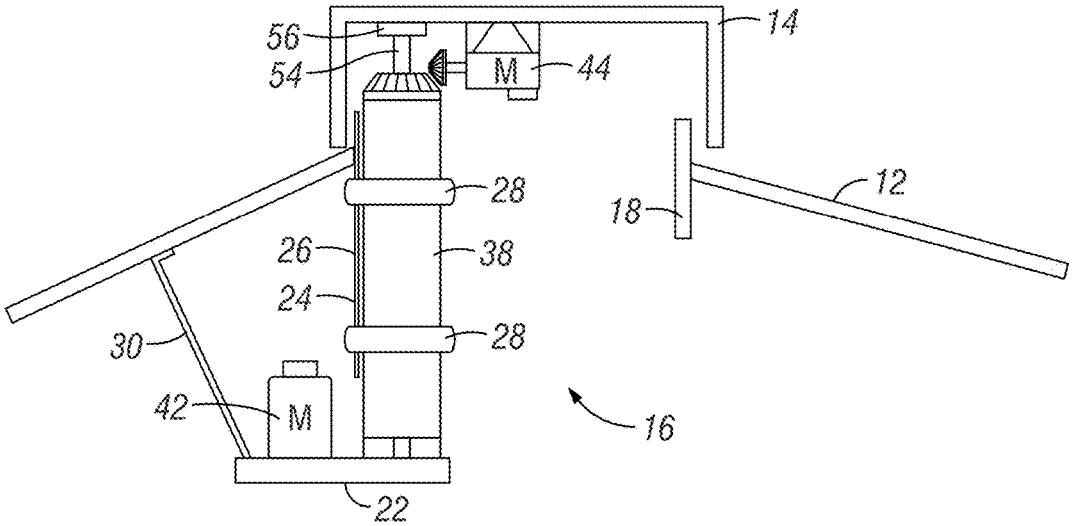
FIG. 5 is across-sectional detail taken along the line shown in FIG. 4 illustrating an actuator according to one embodiment of the present invention.

FIG. 5 is a cross-sectional view taken from FIG. 4, and shows a preferred embodiment for an actuator 16. As can be seen in FIG. 5, a mounting bracket 24 is attached to the top ring 18. The mounting bracket 24 includes a primary bracket 26 that extends vertically downwardly from the inner surface of the top ring 18. Connectors, such as straps 28 extend from the primary bracket 26 to secure the actuator 16 to the bracket 24. The actuator 16 may include amounting base 22 that supports an outer case 38 and a lift motor 42. An additional support brace 30 may be provided between the mounting base 22 and an inner surface of the bin roof 12 to provide additional support for the actuator. Those of skill in the art may be aware of other mechanisms for securely fastening the actuator 16 to the bin 10 in the appropriate position.

Figure 6:
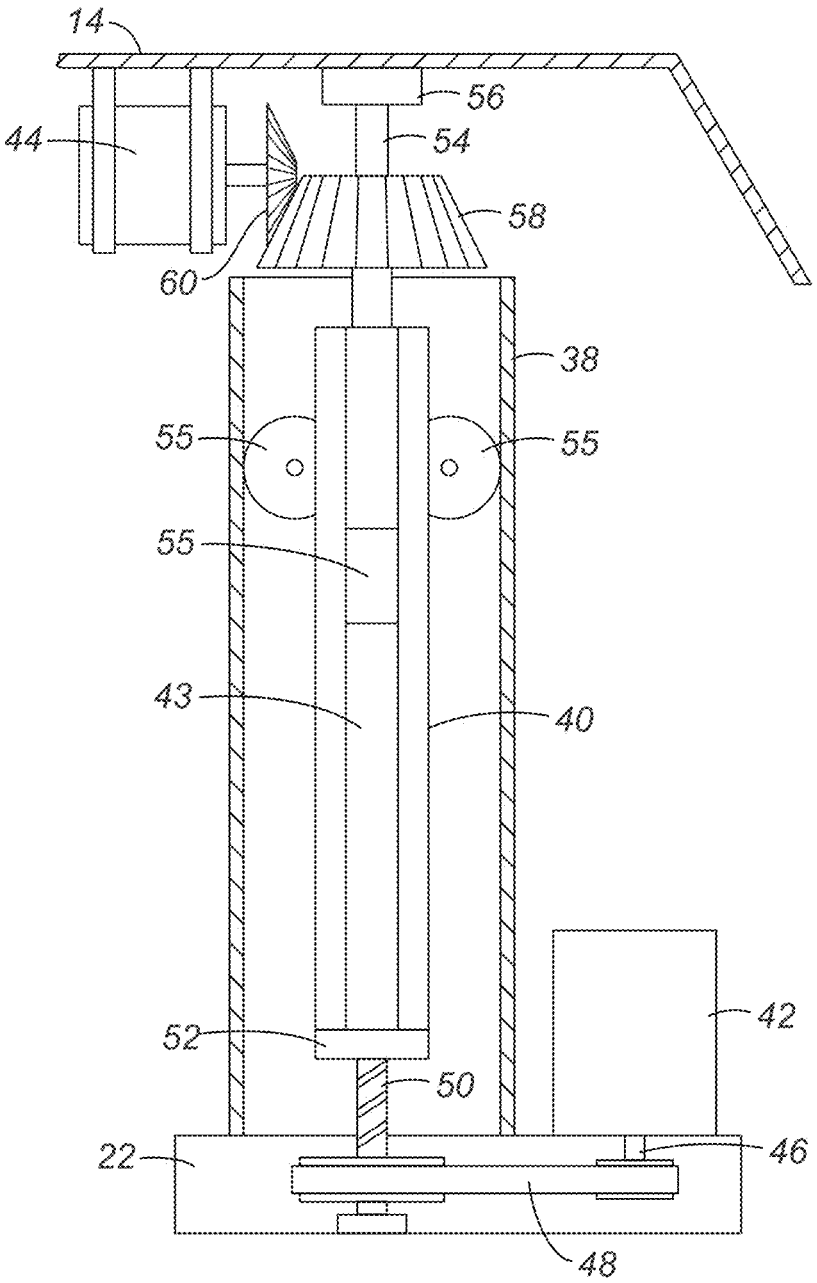
FIG. 6 is a detailed cutaway view of an actuator according to one embodiment of the present invention.

FIG. 6 shows additional features of a preferred embodiment for the actuator 16. The actuator 16 includes a mounting base 22. An outer case 38 is provided that extends upwardly from the mounting base. The outer case 38 is preferably a hollow tube, such as PVC pipe, or similar material. A lift motor 42 is provided on the mounting base 22, and includes an output shaft 46 that drives belt 48, which in turn turns lift screw 50. Lift screw 50 engages nut 52 provided on a lower end of lifting column 40. Lifting column 40 is constrained to prevent rotation relative to the outer case 38, therefore, as screw 50 turns within nut 52, the lifting column 40 is raised and lowered within the outer case 38. Alignment rollers 55 may be provided between the inner surface of the outer case 38 and grooves 4341 formed in the outer surface of the lifting column 40 to retain the lifting column 40 at a proper alignment within the case 38. A rod 54 extends upwardly from the top of the lifting column 40. The rod 54 is received within and captured by receiver 56 that is secured to the underside of lid 14. The rod 54 will freely rotate within the receiver 56.

A beveled gear 58 is also secured to the top of the lift column 40. The beveled gear 58 is engaged by an output gear 60 that is driven by the rotation motor 44. Rotation motor 44 is secured to the underside of lid 14. Therefore, as motor 44 turns output gear 60, the motor 44, and the lid 14 to which it is secured, will rotate about and around the bevel gear 58 in a planetary fashion.

Therefore, in operation, when a user activates the actuator using the controller 32 with the lid 14 in the closed position of FIG. 1, the lift motor 42 is first activated, which in turn causes belt 48 to rotate screw 50 which causes the lift tube 40 to raise within the case 38. The raising of the lift tube 40 also causes the rod 54 as well as the beveled gear 58, and correspondingly the lid 14 to be raised upwardly. The motor 42 continues to be engaged until the lid 14 is raised a sufficient distance to the raised position of FIG. 2 with the lid 14 having clearance above the ring 18. A limit switch may be included, for example, between the case 38 and the lift tube 40, to sense when the lid 14 has been lifted a sufficient distance. Once the lid 14 has been raised a sufficient distance to the raised position of FIG. 2, the lift motor 42 is shut off by the limit switch, and the rotation motor 44 is activated. The activation of the rotation motor 44 will cause the rotation of output gear 60, and hence the rotation of the lid 14 about the rod 54 within receiver 56. The rotation motor 44 continues to rotate until a limit switch sense that the lid 14 has been rotated to the open configuration of FIG. 3, about 180° from its initial position. The motors are then turned off and the lid 14 remains in the open configuration, until a user desires to close it. Alternatively, in the arrangement of FIGS. 7A and 7B, the lift motor 42 may be engaged for a short period to run in the opposite direction to lower the lid 14 slightly into engagement with the support 34, if it is desired to retain the lid 14 in the open configuration for an extended period.

To move back to the closed configuration from the open configuration, everything operates in reverse. When an operator using the controller 32 selects that the lid be closed, the rotation motor 44 is first activated to rotate the lid 14 from the open position of FIG. 3 to the raised position of FIG. 2. A limit switch senses when the lid has rotated back to the raised position of FIG. 2, and the rotation motor 44 is shut off. At that point the lift motor 42 is operated to run in a direction that causes the belt 48 to rotate the screw 50 in a direction that causes the lift tube 40, and therefore the lid 14 to be lowered. Another limit switch senses when the lift tube has reached the position wherein the lid 14 has been lowered to the closed position, and shuts off the lift motor 42.

Figure 9:
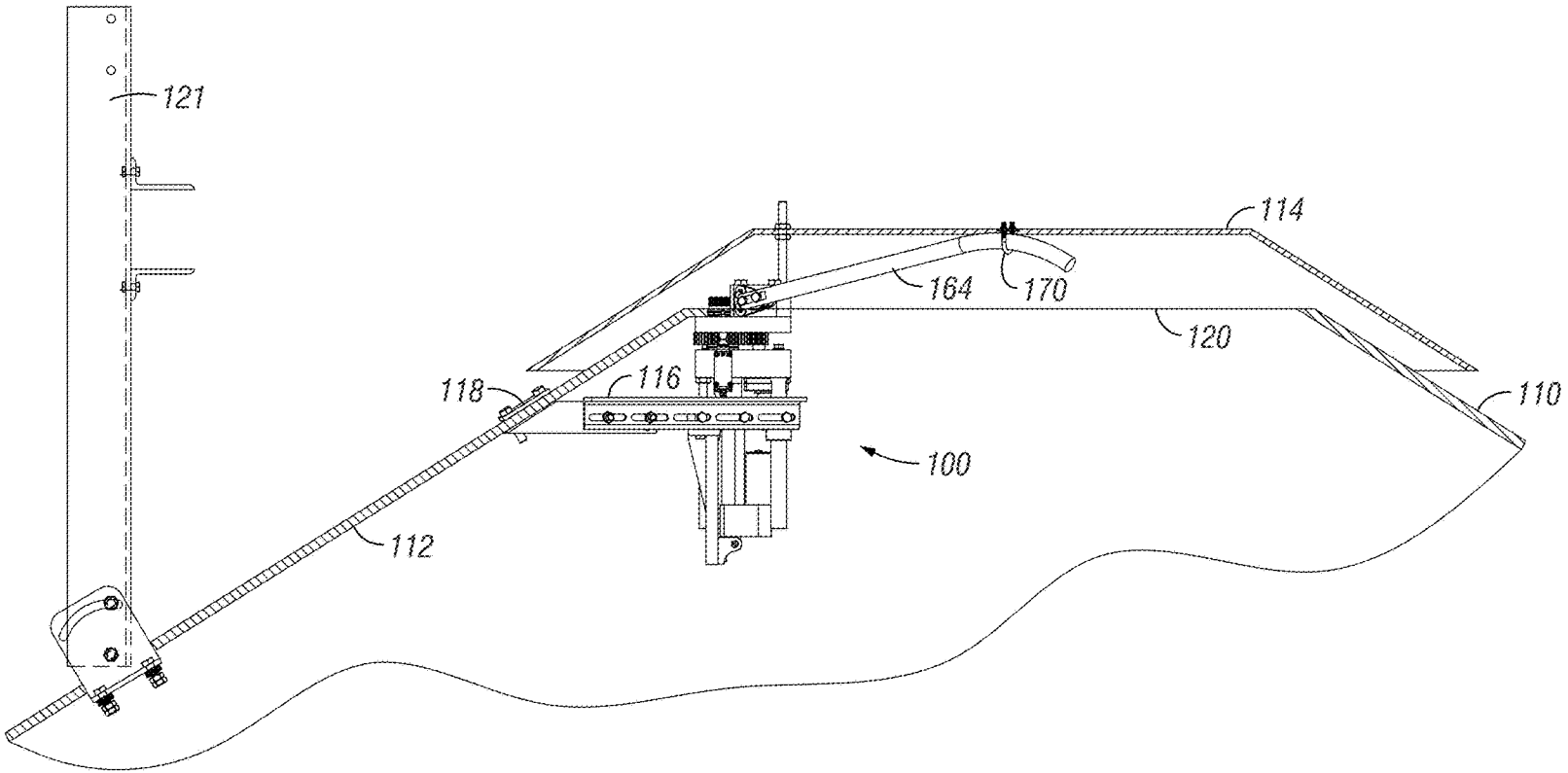
FIG. 9 is a side elevation view of an actuator and lid support bracket attached to a storage bin and lid according to another embodiment of the present invention, the actuator is shown with the lid in a closed position and with the storage bin and lid in partial cross-section.

FIGS. 9-15 show actuator 100 according another embodiment of the present invention. FIG. 9 is amide elevation view showing the actuator 100 mounted within a grain storage bin 110. A lid 114 in a closed position covers an opening 120 in a top portion 112 of the bin 110. Angle brackets 116 are mounted to the top portion 112 by mounting hardware 118. The brackets 116 may be toed inwardly towards each other as a result of extending normally from the inner circumference of the top portion 112. A lid support 121 is mounted to the upper surface of the top portion 112 at a lateral distance from the opening 120. The lid support 121 is provided to help support the lid 114 when it is in an open position (see FIG. 15).

Figure 10:
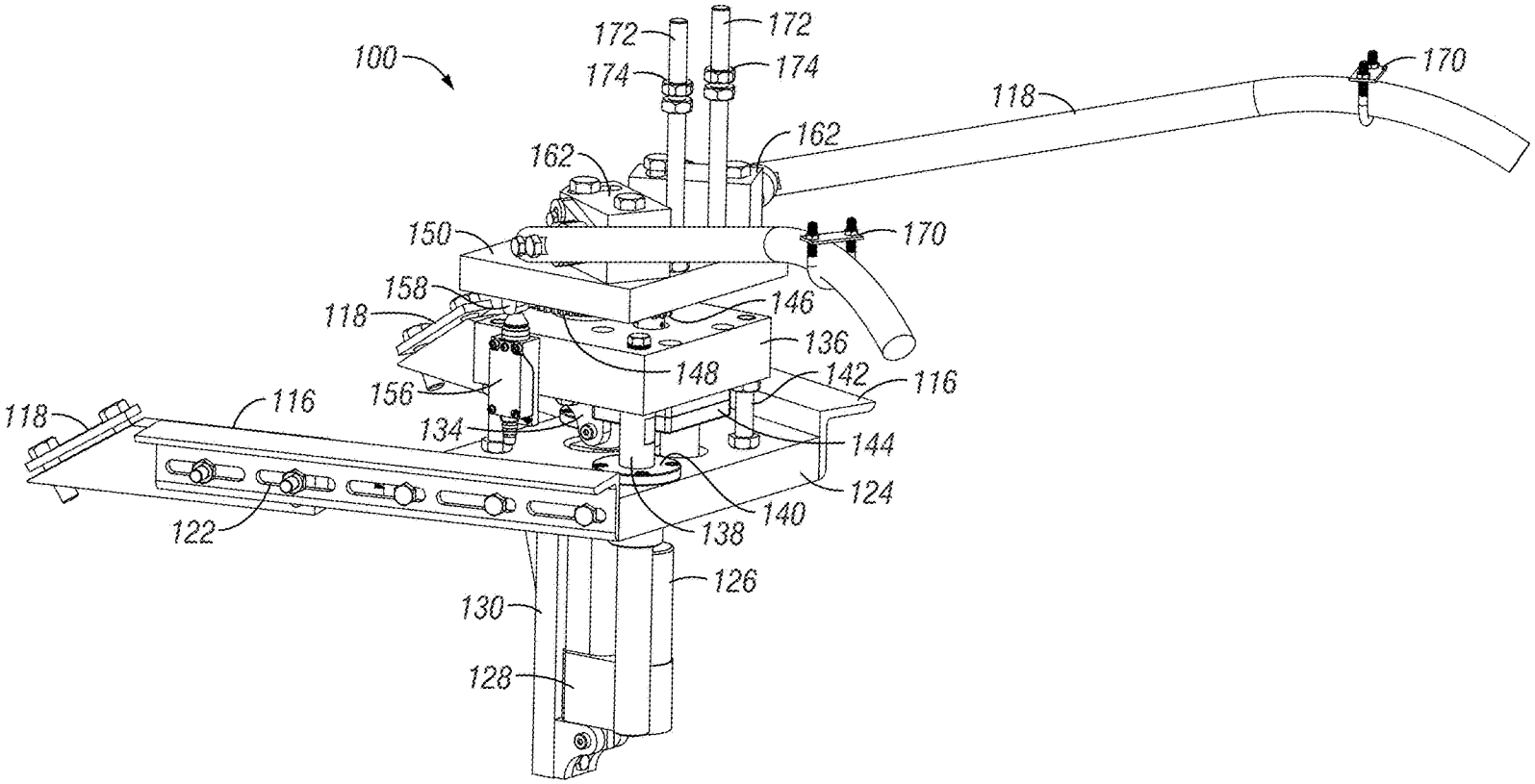
FIG. 10 is a front isometric view of the actuator of FIG. 9.
Figure 11:
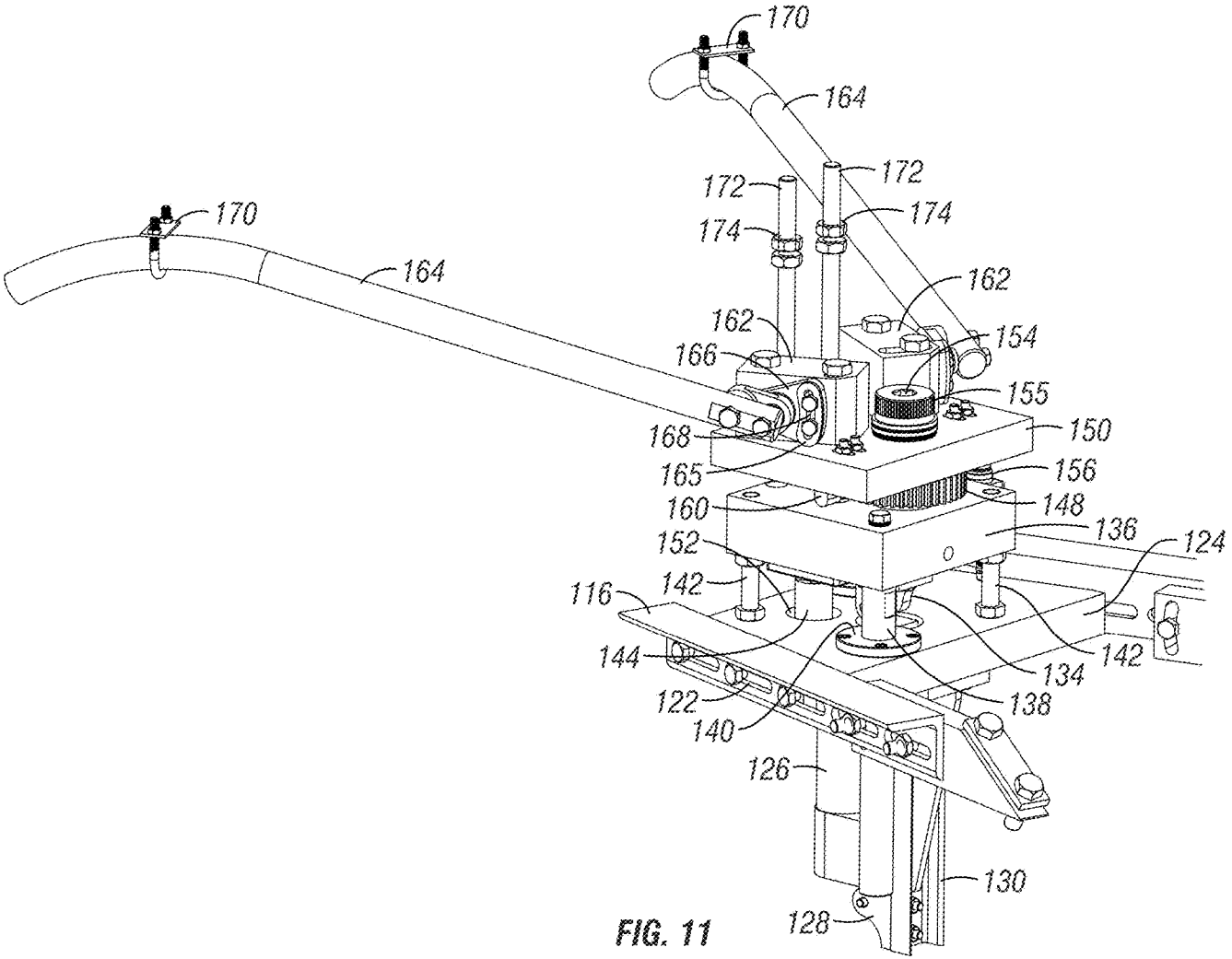
FIG. 11 is a rear isometric view of the actuator of FIG. 9.

As best seen in FIGS. 10 and 11, slots 122 in brackets 116 allow for adjustable mounting of mounting plate 124 to the brackets 116. The mounting plate 124 serves as the stationary base of the actuator 100.

A linear actuator 126 is fixedly mounted below the mounting plate 124 by a mounting bracket 128 and a flange 130. The flange 130 is secured to the plate 124 and the mounting bracket 128 is secured to the opposite end of the flange 128 to support the linear actuator 126. The linear actuator 126 has an actuator rod 132 (best seen in FIGS. 14 and 15) that passes through an opening in mounting plate 124 and attaches to connector 134 that is roughly centered on the bottom surface of lift plate 136. Therefore, vertical movement of the lift plate 136 relative to the mounting plate 124 can be controlled by the linear actuator 126 extending and retracting its actuator rod 132. Those of skill in the art will be aware of several suitable options for commercially available linear actuators. According to one embodiment, a 12V DC linear actuator with a six inch stroke and a feedback potentiometer is suitable, including a commercially available linear actuator sold under the brand name Concentric bearing the item number LACT6P-12V-40. This actuator includes built-in limit switches at each end of its stroke to control the desired range of motion.

Two alignment shafts 138 extend downward from the lift plate 136 at opposite corners of the lift plate 136. The alignment shafts 138 extend downward through the mounting plate 124 at linear bearings 140 provided in the mounting plate 124 directly below the alignment shafts 138. The linear bearings 140 support the shafts 138 laterally, but allow the shafts 138 to move freely up and down with very little friction.

A pair of spacers 142 also extend from the bottom surface of the lift plate 136. The spacers 142 act as stops to maintain the lift plate 136 at a desired distance above the mounting plate 124. The spacers 142 can transfer the weight carried by the lift plate 136 to the mounting plate 124 directly, rather than through the linear actuator rod 132, when the lid 114 is in the standard closed position. The spacers 142 also prevent an excessive load from being applied to the linear actuator 126. This feature saves wear on the linear actuator 126. It should be appreciated that the spacers 142 could alternatively be mounted to the mounting plate 124 and extend upward, rather than extending downward from the lift plate 136 as shown.

A DC gear motor 144 is fixed on the lift plate 136. The gear motor 144 includes an output shaft with a spur gear 146. The output shaft extends through the lift plate 136 and the spur gear 146 meshes with a larger gear 148 fixed to the bottom surface of a rotation plate 150. According to one embodiment, the gear motor 144 has an output of 40 inch-pounds of torque, and will rotate at a speed of 8 rpm. A gear motor meeting these specifications is commercially available from mcmaster.com under the identifier 6409k14. An opening 152 may be provided in the upper surface of mounting plate 124 to prevent interference between the motor 144 and the mounting plate 124 when the lid 114 is in the closed position.

The rotation plate 150 is spaced apart from the lift plate 136 and located above the lift plate 136. The rotation plate 150 is rotatably mounted to the lift plate 136 by a pivot member 154. The pivot member 154 may be the shaft of a shoulder bolt 155. The pivot member 154 is centered with respect to the larger gear 14. Accordingly, rotation of the spur gear 146 by the gear motor 144 will cause the rotation plate 150 to rotate about the pivot member 154.

A limit switch 156 is mounted to the lift plate 136 to shut off the gear motor 144 when the rotation plate 150 reaches its desired positions. According to the embodiment shown, the limit switch 156 is a pin plunger style. A closed position indicator 158 protrudes from the bottom surface of the rotation plate 150 (see FIG. 10) and engages the pin plunger of the limit switch 156 when the rotation plate 150 is oriented such that the lid 114 is aligned with the opening 120. An open position indicator 160 protrudes from the bottom surface of the rotation plate 150 (see FIG. 11) and engages the pin plunger of the limit switch 156 when the rotation plate 150 is oriented such that the lid 114 is rotated to a desired open orientation, for example 180 degrees from the closed orientation. Those of ordinary skill in the art will be aware of other suitable limit switches and other mechanisms for constraining the range of rotational motion.

A pair of arm mounting blocks 162 are secured to the upper surface of the rotation plate 150. Two arms 164 are cantilever mounted to the mounting blocks 162. Preferably the arms are adjustable with respect to the mounting blocks 162 such that the arms 164 can be mounted to a variety of lid configurations. According to the embodiment shown, a pair of threaded fasteners 165 is provided at an outer surface of each mounting block 162. The arm connectors 166 include an arcuate slot 168 that engages the threaded fasteners 165. The arm 164 can be adjusted by tilting the connector 166 on the fasteners 165. Near the distal end of each arm 164 a U-bolt 170 is provided. As best seen in FIG. 9, these U-bolts 170 are used to secure the arms 164 to the underside of lid 114. A pair of lid rods 172 extend upwardly from the upper surface of the rotation plate 150. The lid rods 172 may be threaded at least in part and can have provided there on nuts 174. As best seen in FIG. 9, the lid rods 172 extend upwardly through the lid 114. The nuts 174, in combination with washers (not shown), capture the lid 114 on the rods 172. Therefore, the lid 114 has a four-point connection to the actuator 100 at the two lid rods 172 and the two U-bolts 170.

Figure 12:
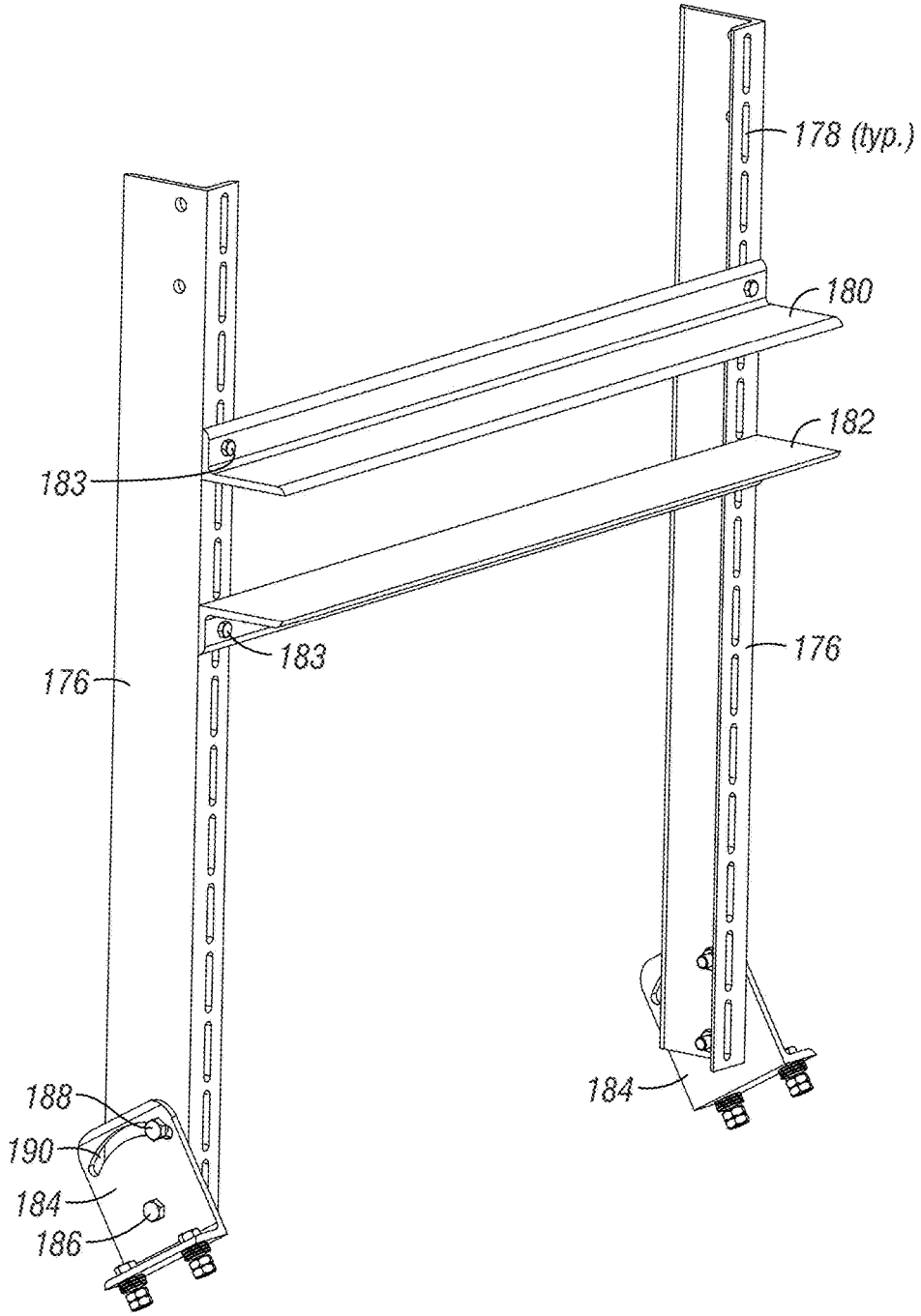
FIG. 12 is perspective view of the lid support bracket of FIG. 9.

FIG. 12 is a perspective view of one embodiment of the lid support 121. The lid support 121 is used to help support the lid 114 in its open position (see FIG. 15). The lid support 121 is designed be configurable to be used with a variety of bin shapes and sizes. The lid support 121 includes uprights 176. The uprights 176 have a plurality of slots 178 at various heights on the uprights. Upper and lower cross members 180 and 182 (respectively) are fastened to the uprights 176 by fastening members 183 in engagement with the slots 178. The cross members 180 and 182 form a pocket into which the lid 114 is received when it is adjusted into the open position. The lower cross member 182 is used to support, at least partially, the weight of the lid 114 when the lid 114 is maintained in an open position. The upper cross member 180 helps prevent significant torque being applied to the at ins 164 during windy conditions that might cause the lid 114 to flip upward. Mounting feet 184 are secured near the lower ends of the uprights 176. Preferably, the mounting feet 184 are angularly adjustable relative to the uprights 176 by being rotatable about a pivot member 186. A tightening member 188 is received within arcuate slot 190, and is used to lock the foot 184 at the desired angle relative to the upright 176. In use, the feet 184 are secured to the upper surface of the top portion 112 of the bin 110. The uprights 176 are adjusted to be generally vertically oriented and the tightening members are tightened to secure the uprights 176 in the vertical position. The angular adjustability allows the lid support 121 to be used on bins with different slopes of their top portions. The cross members 180, 182 can be set to the appropriate height by securing the fastening members 183 in the appropriate slots 178 to vertically align the cross members 180, 182 with the lid 114. The vertical alignment can be fine-tuned by sliding the cross members 180 and 182 up and down with the fastening members 183 in the slots 178.

Figure 13:
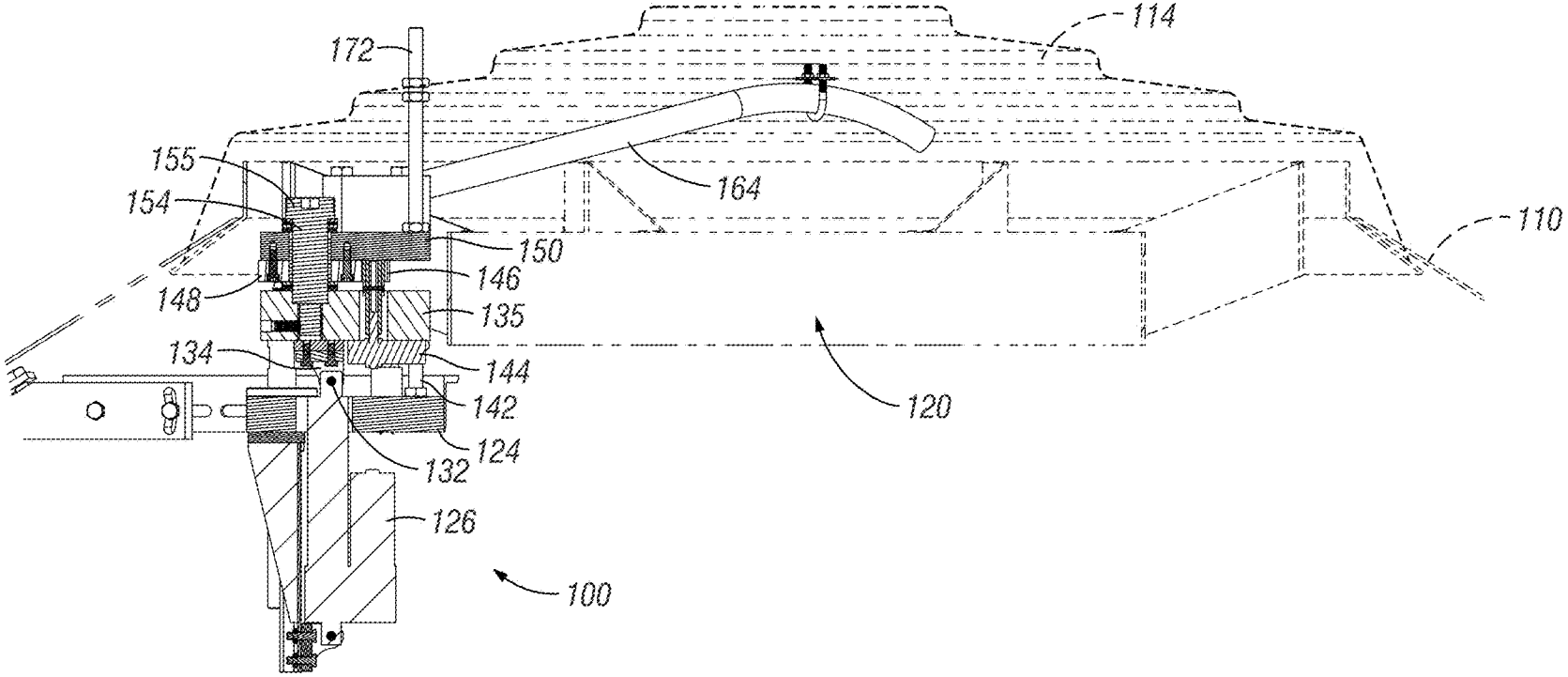
FIG. 13 is a side elevation cross-sectional view of the actuator of FIG. 9 in the closed position, with the lid and storage bin shown in broken lines.
Figure 14:
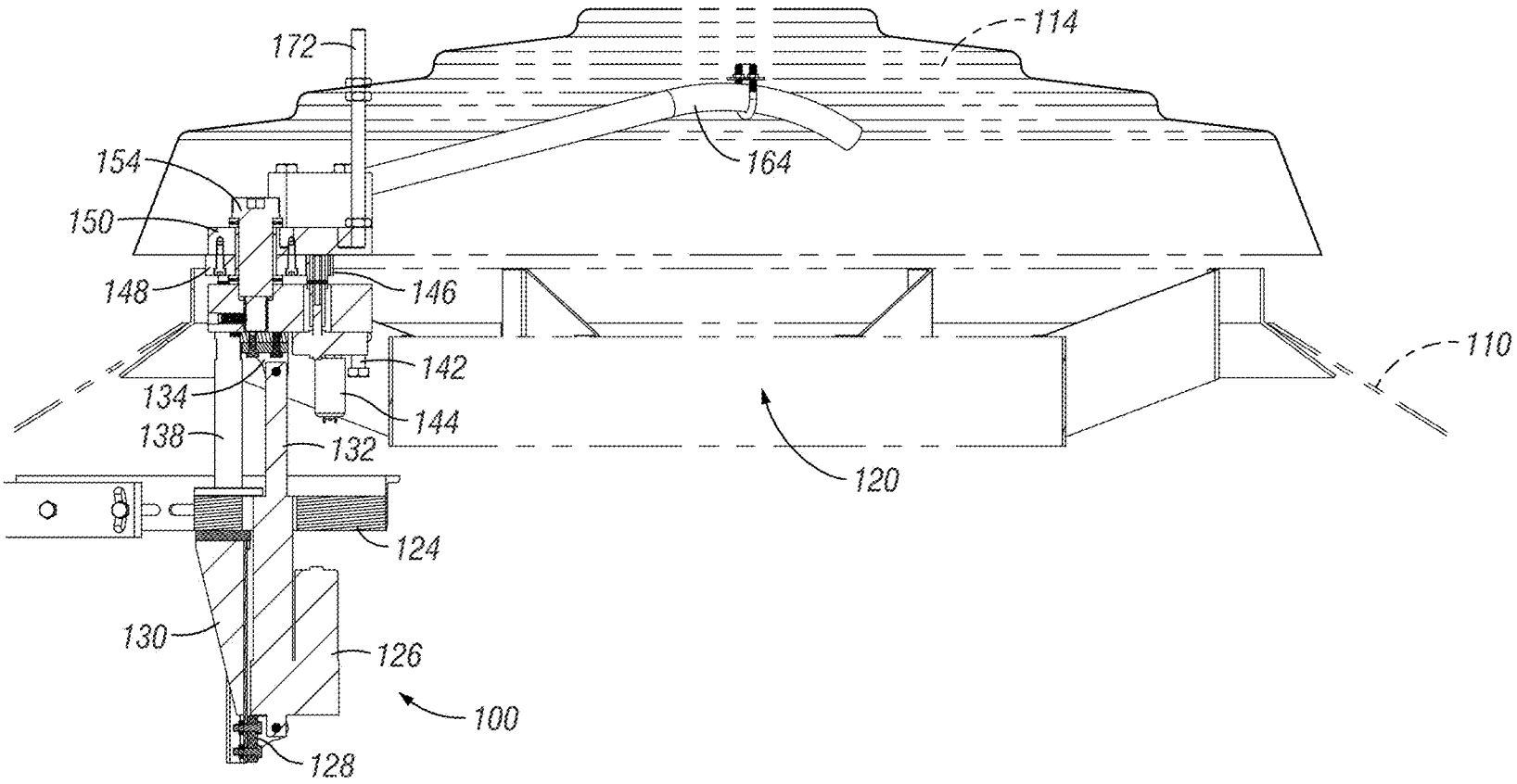
FIG. 14 shows the actuator of FIG. 13 adjusted to a raised position.
Figure 15:
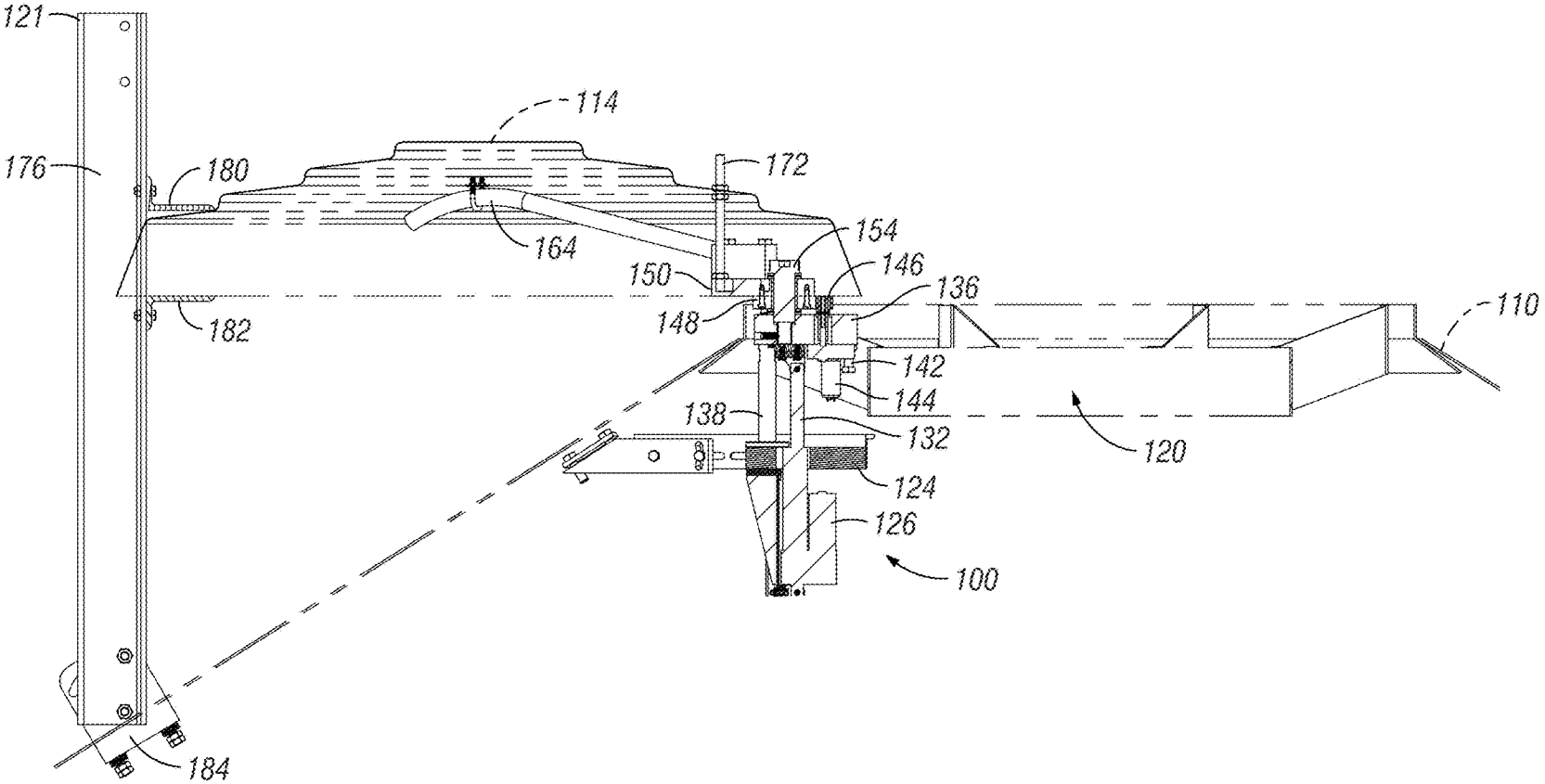
FIG. 15 shows the actuator of FIG. 14 adjusted to an open position.

FIGS. 13-15 illustrate operation of the actuator 100 to adjust the lid 114 (shown in phantom lines) between the closed position of FIG. 13, the raised position of FIG. 14, and the open position of FIG. 15. The closed position of FIG. 13 will be the default configuration. As seen in FIG. 13, in the closed position, the lid 114 is resting on the bin 110 and covering opening 120. The actuator rod 132 is withdrawn to its lowest position within the linear actuator 126. The spacer 142 is in contact with the upper surface of the mounting plate 142.

In FIG. 14, the lid 114 has been adjusted into an intermediate raised position, wherein the lowest portion of the lid 114 has clearance above the upper edge of the top portion 112 of the bin 110. As compared to the closed position of FIG. 13, the actuator rod 13 has been extended upward out of the linear actuator 126. This extension of the actuator rod 132 pushes lift plate 136 upward, which in turn causes the lid 114 to be moved upward. The range of motion is controlled by the settings of the linear actuator 126, which is set to lift the lift plate 136 until the lid 114 has clearance above the bin 110. The raised position of FIG. 14 is typically a temporary position that is passed through when moving into or out of the closed position. The potentiometer within the linear actuator 126 sends a signal to a primary controller 208 (see FIG. 16 and related discussion below). The primary controller then signals the gear motor to start rotating to move the lid 114 towards the position of FIG. 15.

FIG. 15 shows the lid 114 adjusted into the open position. To get from the raised position of FIG. 14 to the open position of FIG. 15, the gear motor 144 is activated to cause rotation of the spur gear 146. In a preferred embodiment, this activation of the spur gear 146 is triggered by a potentiometer within the linear actuator 126 signaling that the lid 114 has been fully raised. This rotation of the spur gear 146, in turn drives the larger gear 148 that is meshed with the spur gear 146. Because the larger gear 148 is fixed to the rotation plate 150, the rotation plate 150 is thereby rotated about the pivot member 154. The rotation of the rotation plate 150 is transmitted to the lid 114 by the lid arms 164 and lid rods 172. The gear motor stops rotating the spur gear 146 when the limit switch 156 is activated by the limit switch open indicator 160 (see FIG. 11). In the open position, the lid 114 is received between the cross members 180 and 182 of the lid support 121. It may be desirable after fully rotating to the open orientation to slightly lower the lid 114 using the linear actuator 126 in order to use the lower cross member 182 to support most of the weight of the lid 114.

In order to move back to the closed position of FIG. 13 from the open position of FIG. 15, the above steps are essentially repeated in reverse. The lid 114 may be slightly raised off of the lower cross member 182 by extending the linear actuator rod 132 to the raised position height. The gear motor 144 is then activated to rotate the rotation plate 150 until the closed position indicator 158 aligns with the limit switch 156 causing the gear motor 144 to stop rotating. This results in the lid 114 being in the raised position of FIG. 14, with the lid 114 aligned directly above the opening 120 in the top portion 112 of the bin 110. The linear actuator 116 then retracts the actuator rod 132, pulling the lift plate 136, and consequently the lid 114, downward. Once the weight of the lid and upper actuator assembly is transferred on to the mounting plate 124 by the spacers 142 the linear actuator 126 stops retracting the actuator rod 132. As described above, the linear actuator may be pre-programmed to have the proper range of motion.

It may be desirable to provide a protective covering for the components of the actuator 100. Such a cover would ideally prevent fouling by dust or moisture, especially at the interface between the spur gear 146 and the larger gear 148. A flexible waterproof material that wraps around the components, but is stretchable to permit expansion is preferred.

Figure 16:
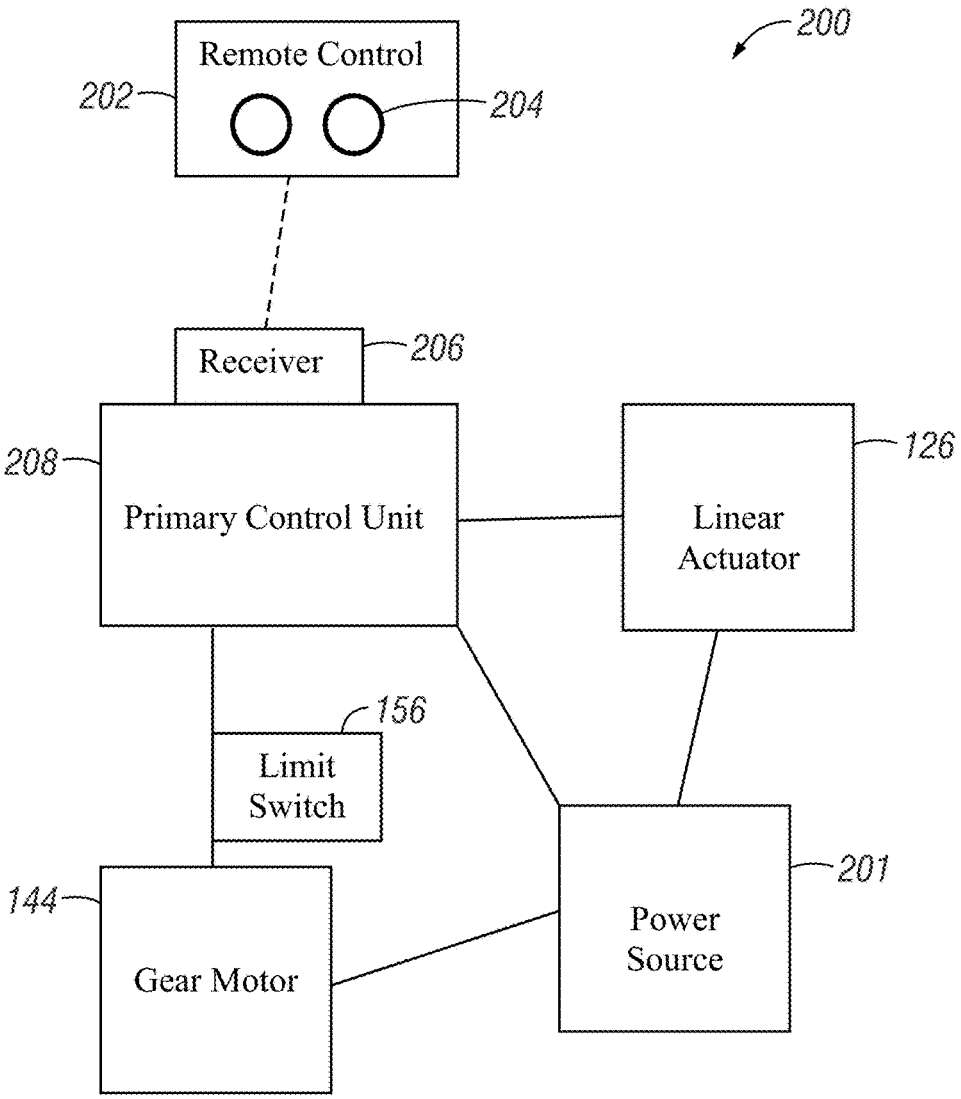
FIG. 16 is a schematic showing one embodiment of a control system.

FIG. 16 is a schematic of an embodiment of a control system 200 that can be used to activate and control the actuator 100. A remote control unit 202 includes an activation interface 204. The remote control unit 202 may be a switch attached to the bin 110. Alternatively, the remote control unit 202 could be a wireless remote control that uses RF or other electromagnetic, sound, or light signals. For example a control similar to those commonly used with garage door openers might be used. It is preferred that the remote control unit 202 be programmable such that it is uniquely identifiable by a particular actuator so that in cases where multiple bins and actuators are used in close proximity to each other, only the desired actuator will be activated. In general, the remote control unit 202 can be any device capable of generating a signal that will initiate operation of the actuator 100.

As a further alternative, the remote control unit 202 might be a smart phone or similar device that interfaces with a receiver 206 via cellular or Wi-Fi connection. The smart phone may be programmed with an app that permits the smart phone to control the opening and closing of the lid.

In general, the activation interface 204 may be a button, switch, keyboard, touch screen, or any structure that can be used to provide input. The remote control unit 202 communicates with a receiver 206 that is adapted to receive and decipher the signals generated by the remote control unit 202. A primary control unit 208 interfaces with the receiver 206 to control the components of the actuator 100. The primary control unit 208 may be a computer, programmable computer board, or other control device. The primary control unit 208 is linked to the gear motor 144 and the linear actuator 126. A power source 210 is connected to the primary control unit 208, the gear motor 144, and the linear actuator 126. The power source 210 may any suitable source of power, including with limitation a utility fed AC line, a battery, a rechargeable battery, a solar cell, or a combination of sources.

In use, a user would use the interface 204 on the remote control unit 202 to activate the actuator 100. For example, when the lid is in a closed position, a user standing on the ground might press and release a button-type interface 204. This would send a signal to the receiver 206, which would be deciphered by the primary control unit 208 to activate the linear actuator 126 to raise the lid 114 to the raised position shown in FIG. 14. Once the primary control unit 208 receives an indication that the linear actuator has reached the raised position, the primary control unit 208 would cause activation of the gear motor 144, which would rotate the lid 114 unit the limit switch 156 terminates rotation of the gear motor when the open indicator 160 trips the limit switch 156. The primary control unit 208 will then signal the linear actuator 126 to lower the lid 114 slightly to a parked open position with the weight of the lid 114 supported by the lower cross member 182.

Figure 17:
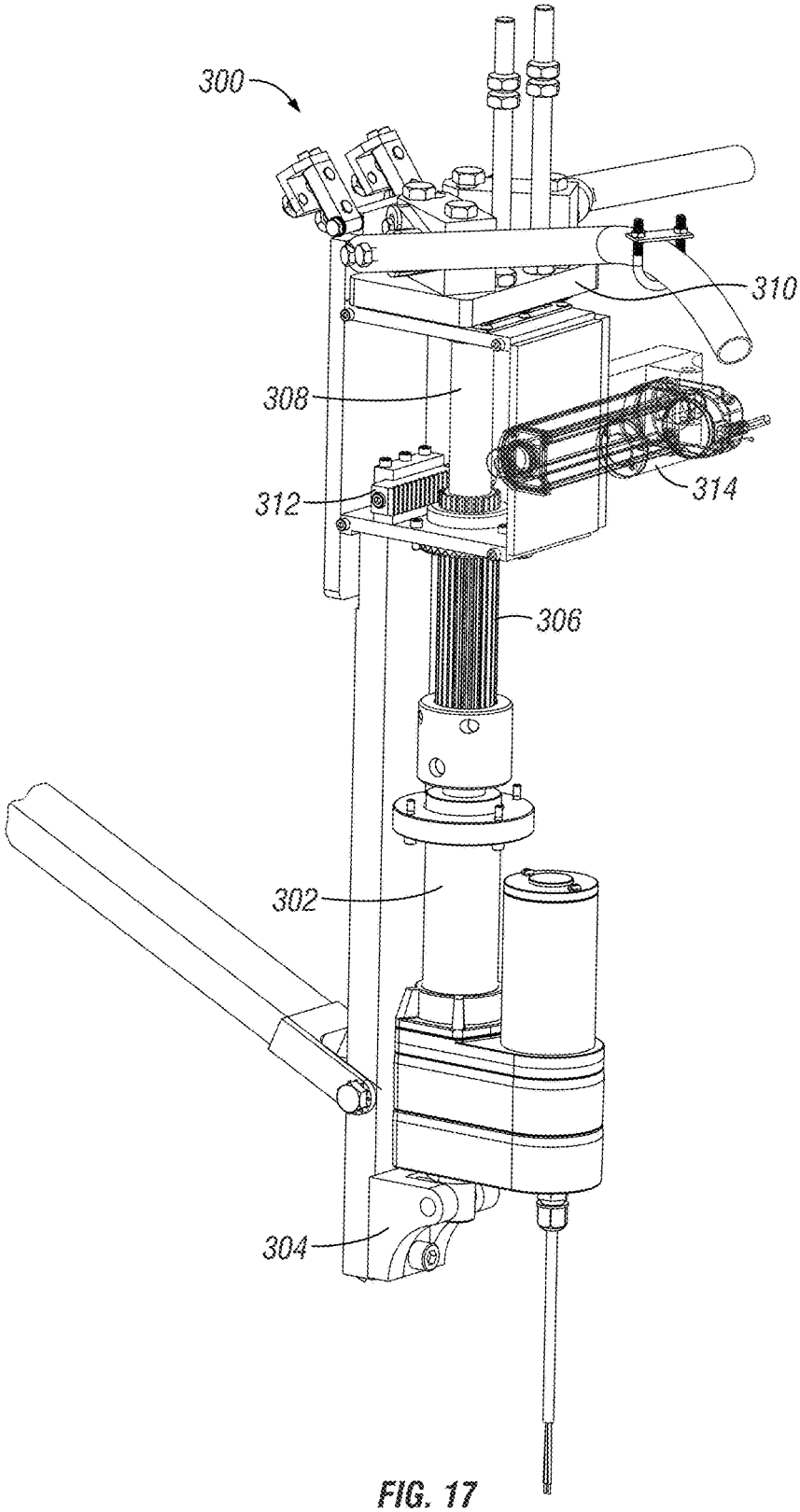
FIG. 17 shows an actuator according to another embodiment of the present invention.

FIG. 17 shows an actuator 300 according to another embodiment of the present invention. The actuator includes a lifting cylinder 302 connected to a mounting bracket 304. The lifting cylinder 302 is preferably an electric cylinder that can be remotely controlled. The lifting cylinder 302 raises and lowers a splined shaft 306. Extending above the splined shaft 306 is a smooth shaft 308 that attaches to a rotation plate 310. The rotation plate 310 has hardware that connects to the lid (not shown). As the lifting cylinder 302 raises and lowers the splined shaft 306, the rotation plate 310 and hence the lid is also correspondingly raised and lowered. The splined shaft 306, at least at the upper portion of its travel, is engaged by a toothed rack 312. The rack 312 has teeth that engage the splines of the splined shaft 306. The rack 312 is attached to a transverse cylinder 314 such that the transverse cylinder can move linearly move the rack 312 to cause rotation of the splined shaft 306, and hence the smooth shaft 308, the rotation plate 310, and the lid.

What is claimed is:

1. A device for opening and closing a lid on a bulk storage bin, wherein the lid covers an opening at an upper area of the bin, the device comprising:

an actuator operably mounted to the bin in operable connection to the lid, the actuator being adapted to lift the lid from a closed position to a raised position above the opening, the actuator further adapted to rotate the lid from the raised position about a vertical axis located at a periphery of the opening until the lid is in an open position;

the actuator being adapted to rotate the lid from the open position back to the raised position and to lower the lid from the raised position to the closed position;

wherein the actuator comprises:

a mounting bracket secured in a fixed position relative to the bin;

a lifting cylinder connected to the mounting bracket;

a splined shaft connected to the lifting cylinder to be raised and lowered by the lifting cylinder;

a rotation plate connected to an upper portion of the splined shaft, the rotation plate being fixedly connected to the lid;

a rack having teeth for engagement with the splined shaft when the splined shaft is in a raised position; and a transverse cylinder for moving the rack to cause rotation of the splined shall and thereby rotation of the rotation plate and lid; and a remote control in communication with the actuator to trigger the actuator to move the lid from the closed position to the open position and from the open position to the closed position.

2. The device of claim 1, further comprising a lid support mounted to the upper area of the bin in alignment with the open position of the lid to support the lid in the open position.

3. A device for moving a lid between a closed position covering an opening at a top of a bulk storage bin and an open position wherein the lid is substantially removed from the opening, the device comprising:

an actuator adapted to lift the lift to an elevated position above the opening and to translate the lid to the open position, wherein the actuator comprises:

a mounting bracket secured in a fixed position relative to the bin;

a lifting cylinder connected to the mounting bracket;

a splined shaft connected to the lifting cylinder to be raised and lowered by the lifting cylinder;

a rotation plate connected to an upper portion of the splined shaft, the rotation plate being fixedly connected to the lid;

a rack having teeth for engagement with the splined shaft when the splined shaft is in a raised position; and a transverse cylinder for moving the rack to cause rotation of the splined shaft and thereby rotation of the rotation plate and lid;

a remote control in communication with the actuator to trigger the actuator to move the lid from the closed position to the open position and from the open position to the closed position; and a lid support mounted to an upper surface of the bin, the lid support adapted to support the lid when the lid is in the open position.

4. The device of claim 3, wherein the lid support comprises:

a pair of uprights;

a lower cross member spanning between the uprights; and an upper cross member spanning between the uprights.

5. The device of claim 4, wherein the lid support further comprises adjustable feet that adjust to match a slope of the upper surface of the bin.

6. The device of claim 4, wherein the uprights each include a plurality of slots that permit adjustment of the heights of the cross members.

* * * * *